US005163502A

United States Patent [19]

Lazzaro et al.

[11] Patent Number: 5,163,502

[45] Date of Patent: Nov. 17, 1992

[54] APPARATUS FOR CASTING LIGHT ALLOYS WITHIN A WATER-COOLED MOLD

[75] Inventors: Giuseppe Lazzaro; Gabriele Masia; Nicola Deplano, all of Portoscuso, Italy

[73] Assignee: Aluminia S.p.A., Portoscuso, Italy

[21] Appl. No.: 624,653

[22] Filed: Dec. 10, 1990

[30] Foreign Application Priority Data

Sep. 5, 1989 [IT] Italy ..... 21627 A/89

[51] Int. Cl.[5] ..... B22D 11/124

[52] U.S. Cl. ..... 164/443; 164/444

[58] Field of Search ..... 164/443, 444, 486, 487, 164/488, 437

[56] References Cited

U.S. PATENT DOCUMENTS 3,885,617 5/1975 Foye .
4,597,432 7/1986 Collins et al. ..... 164/444
4,658,884 4/1987 Euler et al. ..... 164/443

FOREIGN PATENT DOCUMENTS 0192774 7/1985 European Pat. Off. .
0213049 3/1987 European Pat. Off. .
56-39150 4/1981 Japan .
1331333 9/1973 United Kingdom .

*Primary Examiner*—Richard K. Seidel
*Attorney, Agent, or Firm*—Collard & Roe

[57] ABSTRACT

Apparatus for casting light alloys in water, of the type including a cooling water tank used in order to cool a die or ingot mold inserted under tight sealing conditions inside the water tank, and anchored to the water tank. The apparatus uses a water tank which is arranged separate and spaced apart from a casting basin such as to create an air space between the cooling water tank and the basin. The die has a cap or sleeve, inserted inside the water tank under tightly sealing conditions, which have a length that a portion thereof will protrude above the top plane of the water tank. This forms an annular, raised edge, which is high enough as to prevent any possible water leaks between the water tank and the die. Water is prevented from flowing above the annular edge and penetrating the die, consequently causing explosions and/or the projection of liquid metal jets through the casting channel.

3 Claims, 1 Drawing Sheet

APPARATUS FOR CASTING LIGHT ALLOYS WITHIN A WATER-COOLED MOLD

BACKGROUND OF THE INVENTION

1. Field of the Invention

The present invention relates to an apparatus for semi-continuous, vertical casting (casting under closed molten alloy head, or "hot top" casting) in water of the light alloys in general, and of aluminum and its alloys in particular. The apparatus is equipped with coupling means between the ingot mold and the casting equipment, which are structured so as to eliminate any risks of explosion during the casting due to the liquid metal possibly coming into contact with the cooling water.

2. The Prior Art

It is well known that the apparatuses for carrying out the casting of metal alloys, and in particular of aluminum and its alloys, in water, are based on the principle that the liquid metal is cast by gravity. The casting takes place intermittently inside an ingot mold or die of tubular shape, arranged with its main axis being vertical. The mold is surrounded by pressurized cooling water which circulates inside a water tank having a substantially annular shape and arranged externally to and coaxially with the die. The external wall of the die forms the inner wall of the water tank.

The tight seal between the die and the upper and lower walls of the water tank is secured by gaskets. In the so-called floating-die casting apparatuses, the coupling of the die inside the water tank is achieved by inserting the die downwardly from the top into the water tank. A flange of the die is fastened to the upper surface of the water tank.

In the most recent types of apparatuses (known as "hot top" apparatuses), the matrix is inserted inside the water tank from the bottom upwards, and then is anchored to the base wall of the water tank by means of a fastening flange or edge protruding from the bottom end of the die.

The "hot top" type apparatuses furthermore use a connection cap between the liquid metal feed opening provided at the bottom of the molten metal basin and the top portion of the die. The connection cap performs the function of containing and guiding the liquid metal until it reaches that region of the die in which its solidification begins.

The casting in water of the light alloys according to the "hot top" technique and apparatuses can be dangerous. If a sealing gasket fails or the die is not perfectly anchored to the water tank, water can penetrate the interior of the mold, thus coming into contact with the metal in the molten state, causing explosive reactions. These explosive reactions are triggered more easily if substances, such as iron oxides or the like, are present, which can act as catalysts in the oxidation of aluminum, with hydrogen being formed. The risks of explosions can be practically excluded with the "floating-die" casting apparatuses, where the die is inserted from the top down into the water tank. The upper flange or peripheral edge of the die can prevent liquid metal from flowing towards the water tank, and water from flowing towards the die. However, such a drawback can still occur with the casting apparatuses of "hot top" types.

In these kinds of apparatuses, the interface region, i.e., the region in which the guide cap, which guides the flow of the liquid metal entering the die, rests against the die (or ingot mold) and/or its lubricating ring.

These are critical elements and imperfections in the mutual coupling of these elements can cause metal leakages to occur which, by solidifying between the interfaces, lead to the formation of sub-skin surface faults in the shaped product, and therefore to product scraps. Therefore, in practice, in order to prevent such dangerous drawbacks from occurring, the dies and the relevant cap should be submitted to a continuous and careful monitoring and restoration. If these measures are insufficient, the dies will have to be removed and replaced by other dies, and repaired out of line. In these apparatuses, the dies must be inserted inside the water tank from the bottom upwards, in order to enable them to be replaced without the liquid metal feed system having to be dismantled.

As already stated, this method of coupling the die and the water tank with each other causes the risk that if the annular tight-sealing gaskets, in particular the top gaskets, fail, the water pressure existing inside the water tank would enable cooling water to leak through the cap-die interface and enter the interior of the die. This would cause a violent explosion to occur, with jets of liquid metal being projected through the casting channel.

SUMMARY OF THE INVENTION

It is therefore an object of the present invention to provide an apparatus for the vertical casting of light alloys in general and aluminum and its alloys in particular, in water, which is so constructed as to eliminate the risk that cooling water and liquid metal may come into contact with each other.

It is a further object of the invention to eliminate the risk of explosion under any operating conditions and even in the presence of operator errors such as, e.g., an incorrect assembly of the tight-sealing gaskets of the dies.

It is yet another object of the present invention to provide an apparatus for casting in water of the type based on the so-called "hot top" technology, which is equipped with means which are capable of giving the operators, at any time, the possibility of detecting and locating the presence of possible water leaks.

It is still a further object to convey the water leaks towards the external environment which surrounds the die, thus further reducing the risk of explosions and/or projections of liquid metal jets.

A further purpose of the present invention is to provide a casting apparatus of the above-described type in which a floating-die apparatus can be converted with small investment costs and in a reduced time, into an apparatus of "hot top" type, without having to completely reconstruct the water tanks.

These and other objects are achieved according to the invention by a vertical-casting apparatus for casting light alloys and, in particular, aluminum and its alloys, in water. A tank containing pressurized water is provided in order to cool a die or ingot mold centrally inserted under tight sealing conditions inside the water tank. The die is fed from the top, through an opening provided through the bottom wall of a basin designed to contain and feed the liquid metal. The apparatus according to the present invention includes a cooling water tank arranged separately from the upper basin and spaced apart from it, at such a distance as to leave an air space of limited surface-area bounded by the water tank and the upper basin. A vertical die or ingot mold complete with its relevant sealing cap which contains and guides the metal fed to the die or ingot mold is centrally inserted inside the water tank. The die is anchored to the base of the water tank by screws which fasten an anchoring flange or annular edge protruding downwards from the bottom of the die or ingot mold. The die is made so that its height exceeds the height of the water tank, so that it forms an annular edge which protrudes relative to the top plane of the water tank. The annular edge has a height which is sufficient to prevent any water leaks possibly occurring between the die and the water tank in which water may flow over the edge and penetrate the die, causing explosions inside the interior thereof.

More particularly, the air space bounded by the top plane of the water tank by the upper basin and by the raised edge formed by the protruding portion of the die, is in communication with the external environment. This enables the attending operators to immediately detect any possible water leaks.

The instant finding is disclosed in greater detail in the following, in a preferred, non-exclusive form of practical embodiment thereof, by referring to the hereto attached drawing table, supplied for merely indicative, non-limited purposes.

DETAILED DESCRIPTION OF PREFERRED EMBODIMENTS

Figure 1:
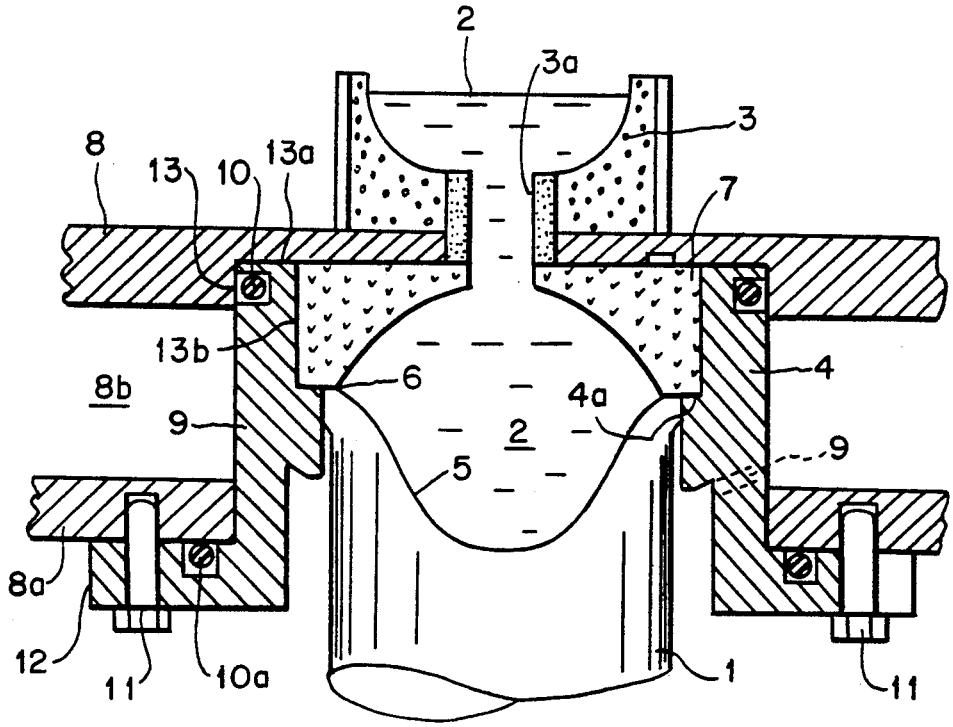
FIG. 1 PRIOR ART
FIG 1 is a schematically axial sectional view of a prior art apparatus with a "hot top" die for casting light alloys, shown for merely comparative purposes.
Figure 2:
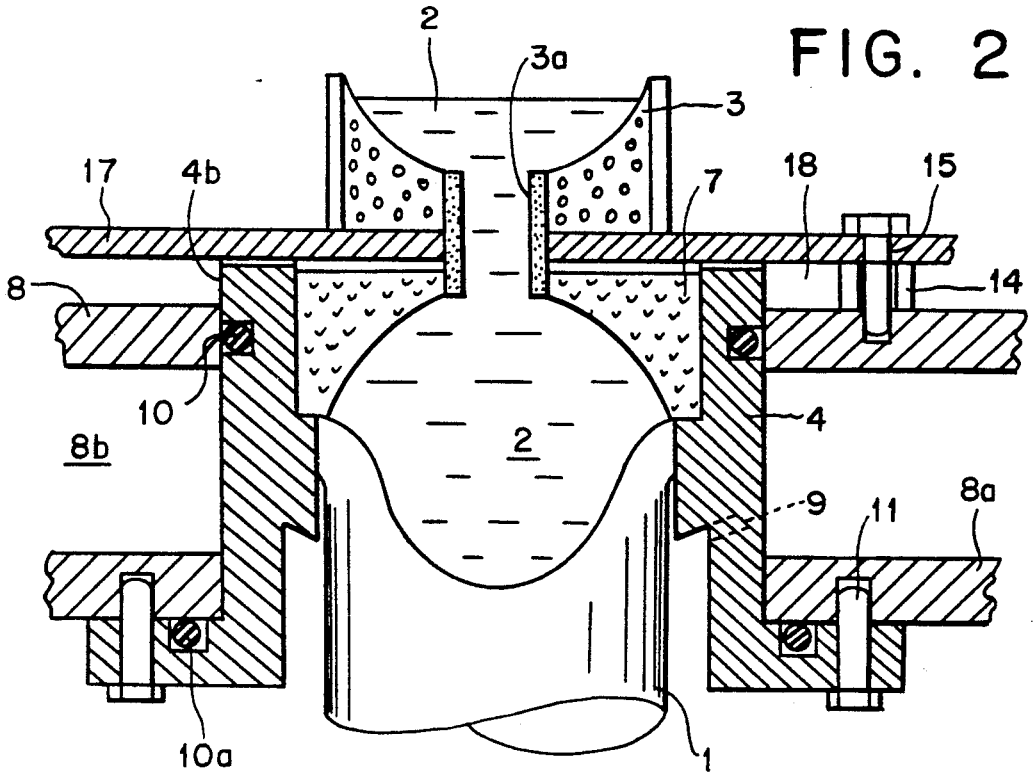
FIG. 2 is a schematic, axial sectional view of a casting apparatus equipped with a "hot top" die, constructed according to the instant finding.

Turning now in detail to the drawing, both of the apparatuses depicted in FIGS. 1 and 2 are used to produce ingots 1 of either cylindrical or prismatic shape, which are formed as liquid metal 2, fed by means of a channel 3 to a die or ingot mold 4, enters the die and solidifies inside it. The solidification takes place according to a line 5 whose initial point is at the region 6 of contact between the bottom wall of a ceramic cap 7 placed atop the die 4 and the support base 4*a* provided on the die.

The structure of the prior art apparatus shown in FIG. 1 substantially comprises a cooling water tank 8*b* formed by two mutually opposite plates 8–8*a*. Plates 8 and 8A are tightly sealed along their peripheral edges by further vertical plates or walls (not shown in the figures). In the center of plates 8–8*a* an opening is provided and through openings a die or ingot mold 4 is inserted upwardly. Die or mold 4 constitutes the sealing wall which, together with plates 8–8*a*, bounds the cooling water tank in the central region.

Therefore, the water tank 8*b* is of annular shape and through it pressurized water is circulated which, during the casting, cools the body of die 4. The water partially runs against a shaped body 1 which is in its solidifying step, through channels 9 provided through the walls of die 4. the sealing tightness between die 4 and plates 8–8*a* is normally accomplished by means of annular gaskets 10–10*a*. The die is anchored to the base of the bottom plate 8*a* of the cooling water tank by means of bolts 11 passing through bores provided on a flange or annular edge 12 integral with the base of die 4.

As already said, this casting apparatus known from the prior art unavoidably creates the risk of explosion. Failures may occur in the upper gaskets 10, or due to an incorrect positioning of the die and/or an irregular positioning of the die and/or an irregular tightening of bolts 11. Failure may also occur owing to thermal expansions of the die and of the relevant ceramic cap or sleeve 7 during the metal casting. Water contained under pressure inside the water tank 8*b* may rise between the surfaces resting against each other, indicated by the reference numerals 13, 13*a* and 13*b* in FIG. 1, and may consequently penetrate the die, causing explosions when the water comes into contact with the liquid metal, and also projections of liquid metal jets through the casting channel 3*a*.

The casting apparatus provided according to the present invention and shown in FIG. 2 totally eliminates the risk of explosions. Its structure is such that any water leaks which may possibly occur between the surfaces, under mutual contact, of water tank 8*b* and die 4 are reliably prevented from penetrating the interior of die 4.

According to the present invention, water tank 8*b* of traditional type (FIG. 2) supports the liquid metal feed unit in a spaced apart position, by means of spacers 14 and relevant through-bolts 15. The height of spacers 14 is such as to define between the base of casting basin 17, which supports channel 3 and relevant casting opening 3*a*, and the surface of a top plate 8 of the water tank, a free air space 18 of a few centimeters in height. Die 4 of "hot top" type, having a shape and dimensions known from the prior art, with or without continuous-lubrication rings and provided, at its top, with ceramic cap 7, is anchored inside water tank 8*b* by means of bolts 11, similar to the case in FIG. 1. The tight sealing against possible water leaks between the water tank and die is secured along the bottom edge by at least one gasket 10*a* and, along the top edge, by a further gasket 10.

In order to prevent water from entering the die in case a failure occurs to gasket 10, die 4 is given a length exceeding (by about 3 cm) the height of water tank 8*b*. Die portion 4*b* which protrudes above plane 8 of the water tank 8*b* constitutes an annular edge whose height is sufficient in order to prevent any possible water leaks through gasket 10 from flowing around edge 4*b* of the die, thus entering the regions in which the basin and the same die rest against each other. On the contrary, any possible water leaks can flow along plane 8 of water tank 8*b* and get discharged to the environment external to water tank 8*b*.

Still according to the present invention, in practice, the particular way of mutual coupling of the water tank and the casting equipment offers the possibility of converting floating-die casting systems into equipment of "hot top" type without water tank 8*b* having to be integrally reconstructed. In fact, water tank 8*b* shown in FIG. 2, if rotated by 180°, i.e., turned upside-down, shows the same structure as the tanks of the traditional casting apparatuses of floating-die type; therefore, in order to convert the casting facilities of the floating-die type, it will be enough to turn upside-down (i.e. to rotate by 180°) the existing water tank, and replace the floating-type dies with dies of "hot top" type, with an installation according t the instant finding being hence accomplished, as shown in FIG. 2.

Finally, it is obvious that the present finding, as hereinabove disclosed according to a preferred form of practical embodiment thereof, can be supplied with structurally and functionally equivalent modifications, without departing from the scope of protection of the invention.

We claim:

1. A vertical hot-top casting apparatus for casting light metal alloys having a mold with a ceramic cap which is inserted upwardly through a cooling water tank positioned below a casting basin having a base provided with means for preventing water leaks between the mold and the cooling water tank which may flow over and penetrate said mold, causing explosions in said mold, said means being in communication with the external environment so as to enable an operator to monitor the apparatus for any water leaks, comprising:

a plate forming the base of the casting basin;

a cooling water tank including a top plate and a bottom plate both provided with openings, said top plate further provided with spacers and first fastening means, said water tank being spaced apart from said base of the casting basin by means of said spacers positioned between the base of the casting basin and said top plate and anchored directly to the base of the casting basin by said first fastening means;

a vertical mold with ceramic cap, and second fastening means, inserted upwardly into the openings of the bottom plates forming a side wall of said cooling water tank and including a flange protruding from the bottom of said mold, which is anchored to the bottom plate by said second fastening means;

at least one lower gasket located between said protruding flange and a downward face of the bottom plate;

at least one upper gasket located along an edge of the top plate between the edge and the mold adjacent to said top plate formed as the side of said cooling water tank, the height of the mold exceeding the height of the cooling water tank so that an annular edge is formed which extends beyond a top plane of said water tank, said annular edge having a height of 3 to 4 cm which prevents water from leaking between the mold and the water tank, which may flow over said edge and penetrate said mold; and wherein said first fastening means passes through said spacers in order to anchor said top plate directly to the base of the casting basin, said top plate being spaced below said base by means of said spacers so as to form a continuous horizontal open space between said top plate and said base of the casting basin.

2. The casting apparatus according to claim 1, wherein said first fastening means are bolts which pass through said spacers to anchor said top plate directly to the base of the casting basin.

3. The casting apparatus according to claim 1, wherein said second fastening means are screws.

* * * * *